US005453734A

United States Patent [19]

Gandhi et al.

[11] Patent Number: 5,453,734

[45] Date of Patent: Sep. 26, 1995

[54] INDUCED BODY CURRENT METERING WORKSTATION MAT

[75] Inventors: Om P. Gandhi, Salt Lake City, Utah; Edward E. Aslan, Plainview, N.Y.

[73] Assignee: The Narda Microwave Corp., Hauppauge, N.Y.

[21] Appl. No.: 863,833

[22] Filed: Apr. 6, 1992

[51] Int. Cl.[6] ..... G08B 21/00

[52] U.S. Cl. ..... 340/664; 340/654; 340/657; 340/660; 324/133; 324/557; 361/91

[58] Field of Search ..... 340/657, 660, 340/661, 664, 654, 650; 324/133, 457, 433, 557; 361/91

[56] References Cited

U.S. PATENT DOCUMENTS

| | | | |
|---|---|---|---|
| 3,309,690 | 3/1967 | Moffitt | 340/657 |
| 4,368,472 | 1/1983 | Gandhi . | |
| 4,714,915 | 12/1987 | Hascal et al. | 340/657 |
| 4,983,954 | 1/1991 | Huston | 340/657 |
| 5,296,844 | 3/1994 | Hanrahan et al. | 340/657 |

*Primary Examiner*—John K. Peng
*Assistant Examiner*—Edward Lefkowitz
*Attorney, Agent, or Firm*—Hoffmann & Baron

[57] ABSTRACT

A workstation mat used to monitor radio frequency, electromagnetic field induced currents flowing through the body of a person standing on the workstation mat. The workstation mat includes an upper and lower conductive plate residing in parallel planes. The upper plate is superposed in spaced apart relation over the lower plate. The mat also includes an electronic circuit coupled to the conductive plates. The electronic circuit senses the induced current flowing through a person's body and sounds an alarm to warn the worker when the induced body current meets or exceeds a predetermined current threshold. The threshold setting is variable and preset by the user. The workstation mat has a reset button switch mounted on one lateral side and contains connectors for a remote alarm and a remote reset switch.

14 Claims, 6 Drawing Sheets

INDUCED BODY CURRENT METERING WORKSTATION MAT

BACKGROUND OF THE INVENTION

FIELD OF THE INVENTION

The present invention relates to a metering device to measure currents induced in the human body, and more specifically relates to a metering device to measure currents induced in the human body from exposure to radio frequency, electromagnetic fields.

Recently proposed modifications in the safety guidelines with respect to human exposure to radio frequency, electromagnetic fields require measurements of induced body currents to ascertain that these currents are lower than maximum allowable currents. The induced body currents that are measured represent the amount of current passing through the feet of an individual to ground. The current passing through an individual exposed to electromagnetic fields has only recently become a safety concern.

Limits on body to ground current for workers exposed to radio frequency, electromagnetic fields have recently been proposed by the International Radiation Protection Association (IRPA) of the World Health Organization (WHO), in Canada and other foreign nations such as the United Kingdom. The Institute of Electronic and Electrical Engineers (IEEE) has determined safety levels with respect to human exposure to radio frequency, electromagnetic fields between 3 KHz to 300 GHz (IEEE C95.1- 1991). The American National Standards Institute (ANSI) has also been considering publishing a national standard safety level with respect to human exposure to radio frequency, electromagnetic fields. Exposure to radio frequency, electromagnetic fields has been determined to create some health hazards to workers.

Due to the health hazards-with respect to human exposure to radio frequency, electromagnetic fields, it is necessary for employers to monitor workers who are exposed to such fields. Therefore, there is a need for a reliable, portable, accurate metering device which can monitor exposure levels as well as sound an alarm if the levels exceed safety guidelines.

OBJECTS AND SUMMARY OF THE INVENTION

It is an object of the present invention to provide a metering device to monitor a worker's exposure to radio frequency, electromagnetic fields.

It is another object of the present invention to provide a metering device which measures induced current caused by exposure to radio frequency, electromagnetic fields which is accurate to within ±10% over a wide band of operation.

It is a further object of the present invention to provide an induced current meter which is portable and reliable, and is in the form of a workstation mat.

It is yet a further object of the present invention to provide an induced current metering device which alarms when a threshold setting of induced current is reached.

It is still another object of the present invention to provide an induced current metering device which has the capability to sound a remote alarm as well as having a remote reset.

It is another object of the present invention to provide an induced current metering device which has a variable threshold setting.

In accordance with one form of the present invention, the radio frequency, electromagnetic field induced current metering device is constructed in the form of a mat to be placed on the floor at a workstation. The mat includes upper and lower conductive plates residing in parallel planes, one superposed on the other and separated by an insulating material, a DC power source and an electronic radio frequency, electromagnetic field induced current sensing circuit. The two conductive plates may be formed of aluminum approximately 24×36 inches in size. The upper plate may be covered with a rubberized or other non-skid material which the worker stands on, and the lower plate may include strips of non-skid material affixed to the bottom surface, which contacts the floor and prevents the mat from slipping. Alternatively, the conductive plates and insulating material may be housed within a protective outer covering to shield it from dirt and other foreign matter. The insulating material may consist of ¾ inch thick styrofoam approximately the same size as the conductive plates. The styrofoam has a cutout section in which the electronic current sensing circuit is located. The electronic current sensing circuit may contain a light emitting diode to indicate that the metering device is energized.

The electronic current sensing circuit also preferably includes an adjustable threshold setting and a high and low current scale. The user may select either the high or low current scale over which the workstation mat operates by a range select switch. The low current scale may be set to a maximum of about 60 milliamps and the high current scale may be set to a maximum of about 200 milliamps by the range select switch. The threshold setting can also be adjusted by a potentiometer. The potentiometer preferably allows the user to adjust the threshold setting from about 20 milliamps to about 60 milliamps when the range select switch is set on the low current 60 milliamp scale and from about 70 milliamps to about 200 milliamps when the range select switch is set on the 200 milliamp scale.

The radio frequency, electromagnetic field induced current metering device also includes an audible alarm. The audible alarm sounds when the threshold setting is reached. The audible alarm is located within the electronic current sensing circuit positioned in the cutout of the insulating material and below the upper conductive plate. The upper conductive plate contains perforations above the audible alarm to allow the sound to emanate from the device.

The electronic current sensing circuit may also include a dual coil latching relay to provide the capability of sounding a remote alarm. The metering device also preferably includes circuitry for the capability of having a remote reset, as well as a push button reset switch mounted on the side of the metering device.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
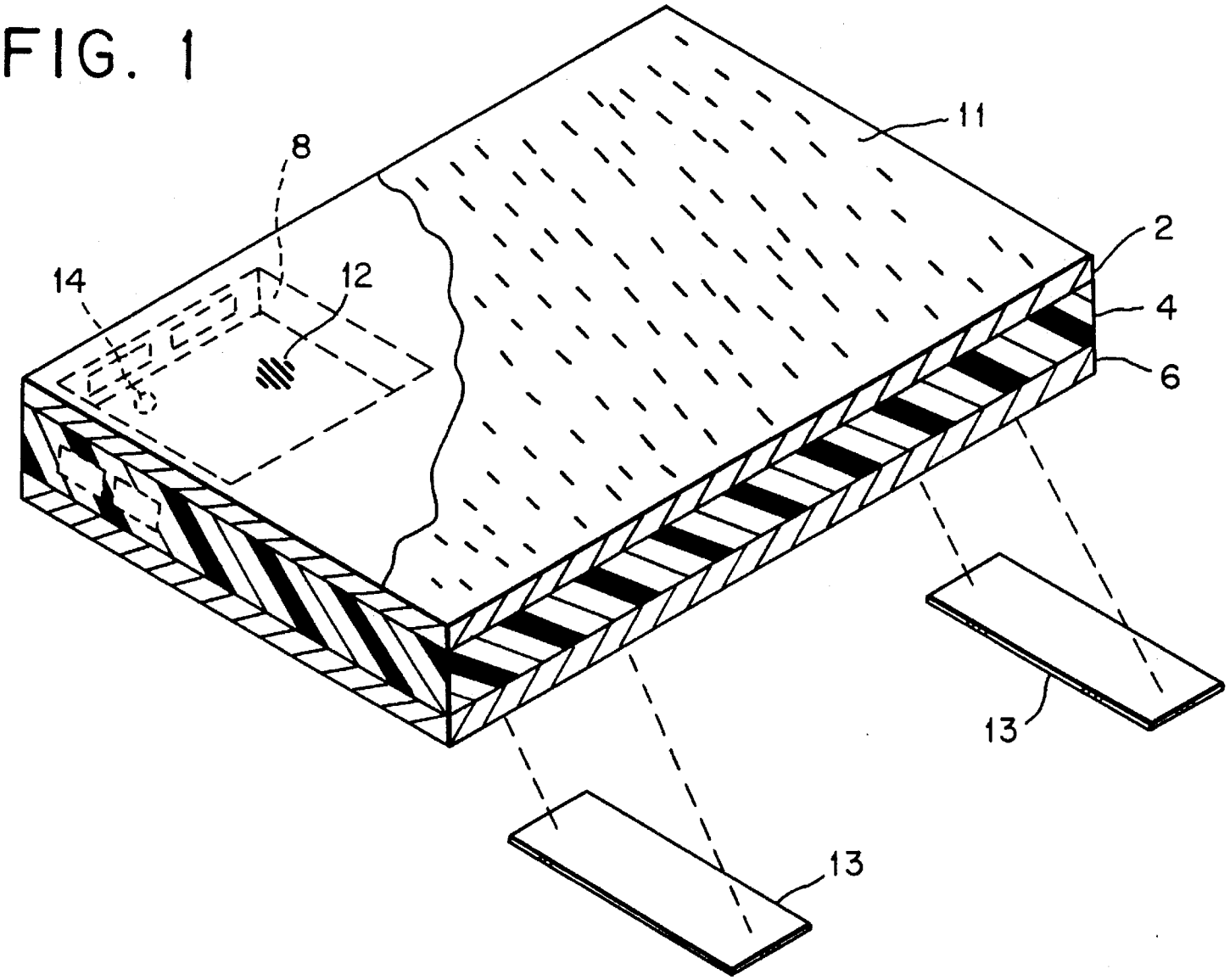
FIG. 1 is a partially exploded view, in perspective, of a portion of the induced body current metering workstation mat of the present invention.

Referring initially to FIG. 1 of the drawings, it will be seen that an induced body current metering device, constructed in accordance with one form of the present invention, is formed as a substantially flat, low profile mat that may be conveniently positioned at a workstation on the floor so that a worker may stand on it while he is working. The mat will not hinder or interfere with the worker's performance, and yet it will monitor and measure currents induced in his body by radio frequency, electromagnetic fields and will alert the worker and others in the workplace when such field induced body currents exceed a predetermined threshold.

The workstation mat includes thin upper and lower conductive plates, 2 and 6 respectively, residing in parallel planes, the upper plate 2 superposed on the lower plate 6 in spaced apart relation, and separated by an insulating material 4. The upper and lower conductive plates 2, 6 may be comprised of various metals. In one form of the present invention, the upper and lower conductive plates 2, 6 may be formed of a thin aluminum material and are dimensioned to be rectangular and approximately 24×36 inches in size. The insulating material 4 may consist of ¾ inch thick styrofoam approximately the same size as the conductive plates.

Figure 2:
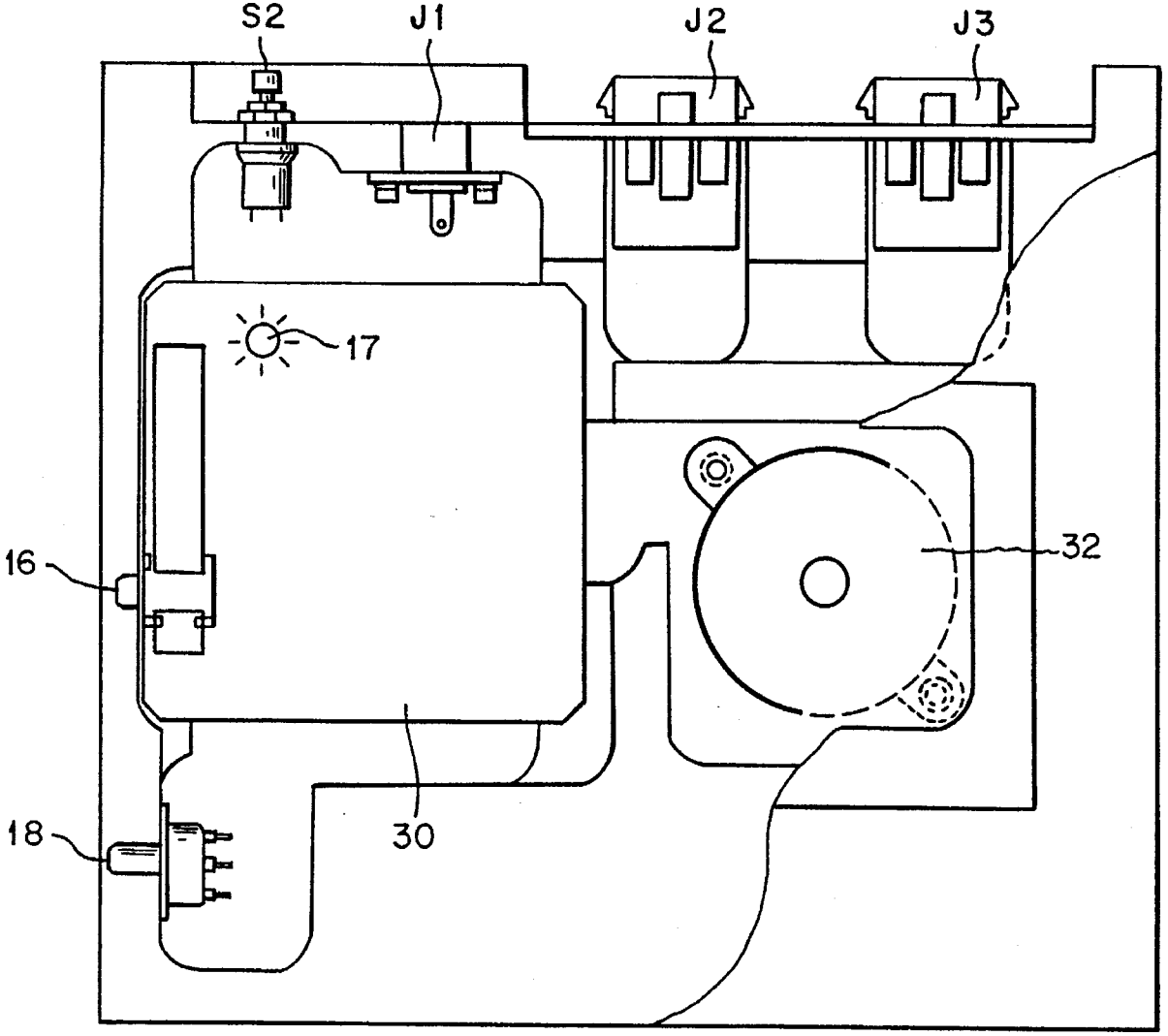
FIG. 2 is a top plan view of a portion of the workstation mat of the present invention, partially broken away to show internal components of the mat.

The insulating material 4 has a cutout section 8 formed in it in which the electronic current sensing circuit of the mat is located. Also located within this cutout 8 is an audible alarm 32 and a light emitting diode (LED) 17, each of which is shown in FIG. 2. The LED 17 is provided to indicate that the metering device is energized, and the alarm 32 is provided to alert the worker that his measured body current exceeds a preset threshold. The upper conductive plate 2 has perforations 12 formed through its thickness and situated above the audible alarm to allow the sound to emanate from within the insulating material cutout 8. The upper conductive plate 2 also has formed through its thickness a small circular cutout 14 situated above the LED 17 to allow the LED to emit light through the upper plate. The LED 17 when lit indicates to the worker that the current metering device is energized.

The workstation mat may also include a covering 11 formed of a rubberized or other non-skid material. The covering 11 is secured by adhesive or the like to the top surface of the upper conductive plate 2 so that the worker will not slip on the mat when he stands on it. The mat may also include a bottom covering or strips of a non-skid material 13 affixed to the bottom surface of the lower conductive plate 6 to prevent the mat from slipping on the workplace floor. Alternatively, the conductive plates and insulating material may be housed within a protective outer covering (not shown) to shield it from dirt and other foreign matter.

FIG. 2 is a top view of the induced current metering mat at the cutout 8, with the upper conductive plate 2 partially broken away to show the various components which are located within the insulating material cutout 8. The components within the cutout 8 of the insulating material include a range select switch S1 for the user to select either of a high or low current monitoring range, a slide potentiometer R4 to adjust the current threshold setting necessary to trigger the alarm, a push button reset switch S2, a connector J1 for connection to a remote DC power supply, a connector J2 for connection to a remote alarm, a connector J3 for connection to a remote reset switch or relay, an audio alarm 32 such as a pulsing piezo buzzer, and a circuit board 30 on which the components of the induced body current sensing circuit are mounted.

The workstation mat provides the worker with two current ranges to select from—a low current range, which when selected allows the mat to be sensitive to induced currents preferably at or below about 60 milliamps (mA), and a high current range, so that the mat will react to currents preferably above 60 mA to about 200 mA. The range select switch S1 allows the operator to choose either a low current scale (60 mA) threshold setting or a high current scale (200 mA) threshold setting. The slide potentiometer R4 allows the operator to adjust the current threshold setting which will trigger the alarm from about 20 mA to about 60 mA when the range select switch S1 is on the low current, 60 mA scale, and from about 70 mA to about 200 mA when the range select switch S1 is in the high current, 200 mA range position. The operator, depending upon which guideline (ANSI or IEEE) he wishes to follow, may adjust the threshold setting to any desired value.

Figure 3:
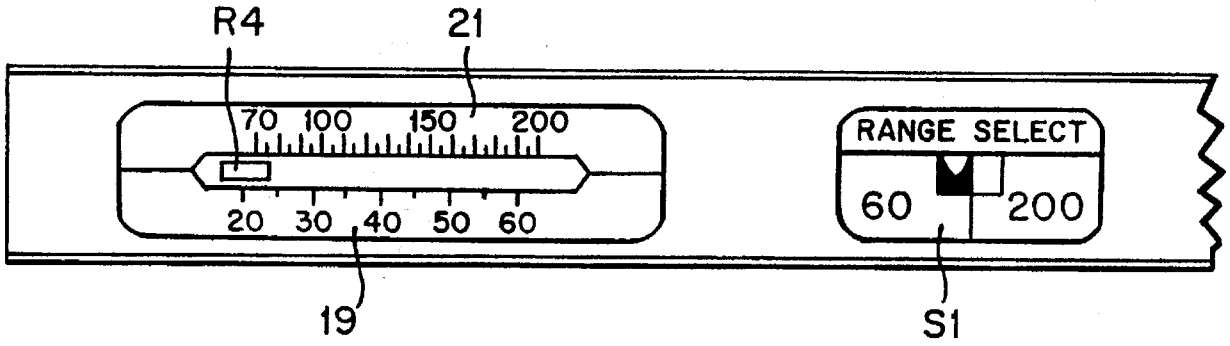
FIG. 3 is a side view of a portion of one lateral side of the workstation mat of the present invention.

As shown in FIG. 3, the range select switch S1 and the threshold setting slide potentiometer R4 are positioned in the cutout 8 so that they are exposed on one side of the workstation mat so that the operator may easily adjust the desired threshold setting for induced current for which the operator desires that an alarm be sounded.

Two scales 19, 21 each with graduations, are mounted on the side of the mat and situated on opposite sides of the slide potentiometer R4. One scale 19 corresponds to the low current range, and the other scale 21 corresponds to the high current range. The scales are provided so that the user can visually judge the threshold he selects by aligning the wiper of potentiometer R4 with the scale graduation corresponding to the desired current threshold.

Figure 4:
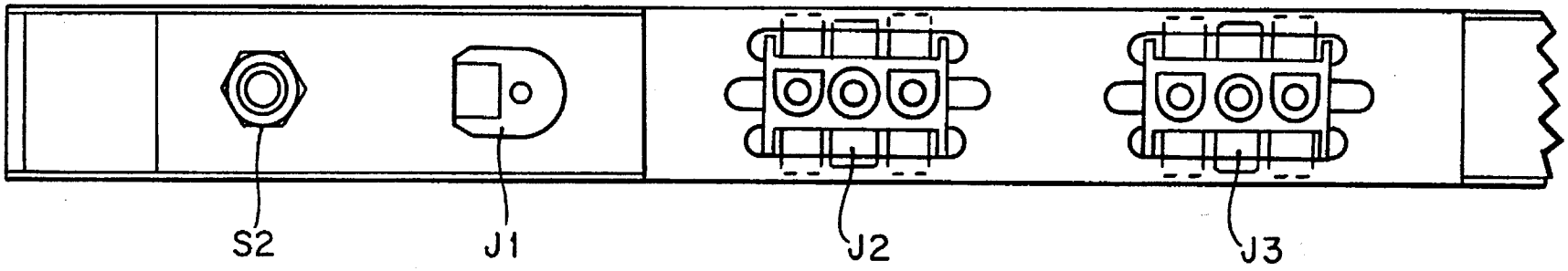
FIG. 4 is a side view of a portion of another lateral side of the workstation mat of the present invention.

As previously noted, the radio frequency, electromagnetic field metering device includes an audible alarm 32. The audible alarm 32 sounds when the threshold setting for induced current is reached. The audible alarm 32 may include a pulsing piezo buzzer. When the threshold setting for induced current is reached and the alarm sounds, the operator may reset the metering device by pressing the push button reset switch S2. As shown in FIG. 4, the reset switch S2 is located in the cutout so that it is exposed on a side of the workstation mat. When the reset switch S2 is pushed, the audible alarm 32 will shut off and the current sensing circuit on circuit board 30 is reset.

FIG. 2 also shows a connector J3 to which a mating connector coupled to a remote reset switch S3 may be plugged in. The remote reset switch S3 may be operated some distance from the metering device and works in a similar manner to the reset switch S2 located on the side of the mat, as will be described in greater detail in connection with the current sensing circuit of the mat.

The metering device also contains a connector J2 to which a mating connector coupled to a remote relay 60 and alarm 62 may be plugged in. The remote alarm 62 will be triggered by the mat and may be placed some distance from the metering device and sounded when the field induced current equals or exceeds the threshold setting.

The workstation mat may include a battery (not shown) located in cutout 8, or more preferably is powered from an external DC power source 31. The mating connector of the external DC power source 31 may be plugged into the DC power input connector J1. When the metering device is energized, the light emitting diode (LED) 17 will be lit. The LED 17 thus will indicate to the operator that the metering device is energized. As shown in FIG. 4, the reset switch S2, the connector J1 for the DC power input, and the two connectors for the remote alarm and remote reset, J2 and J3 respectively, are all situated in the cutout 8 so that they are exposed on a side of the workstation mat and are, therefore, easily accessible.

Figure 5:
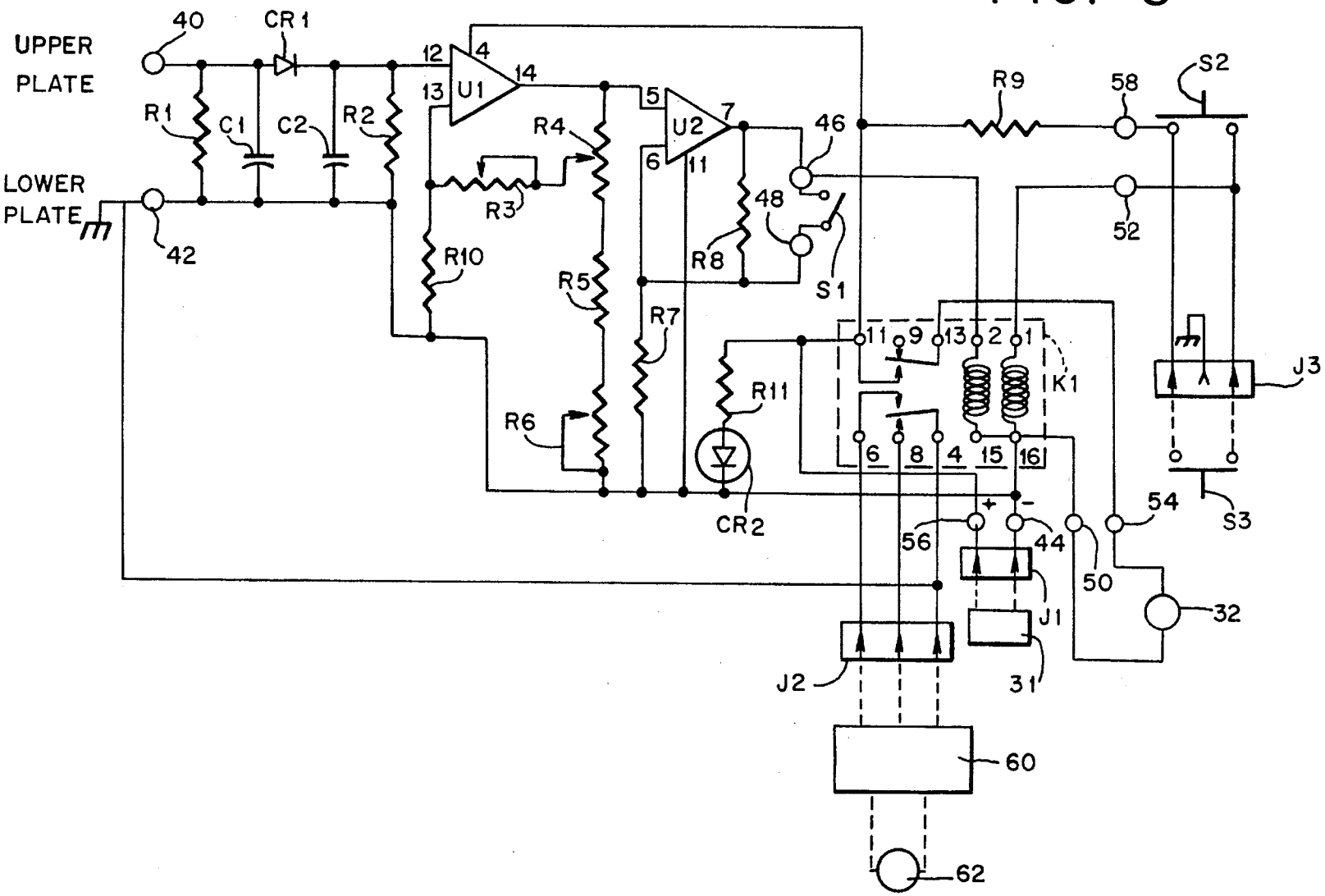
FIG. 5 is a preferred form of an electronic circuit used in the induced current metering workstation mat of the present invention.

FIG. 5 illustrates one form of an electronic current sensing circuit for use with the induced body current metering device of the present invention. The sensing circuit is connected to the upper and lower conductive plates 2, 6 of the mat. Current induced in the human subject standing on the mat is measured and monitored by the sensing circuit.

The sensing circuit includes a sensing resistor R1 which is connected across circuit board terminals 40, 42 which are respectively coupled to the upper and lower conductive plates 2, 6. A capacitor C1 is placed in parallel with resistor R1 to improve the frequency response of the circuit board terminal 42, and thus lower conductive plate 6, are connected to system ground, which is the negative side of the DC power input to the circuit (see circuit board terminal 44).

A diode CR1 has its anode electrically connected to circuit board terminal 40 and thus the upper conductive plate 2. The diode CR1 acts as a diode detector to detect the envelope of the voltage impressed on sensing resistor R1 due to the field induced current flowing through the upper and lower conductive plates 2, 6.

The cathode of the diode detector CR1 is connected to the parallel arrangement of capacitor C2 and resistor R2, whose other legs are connected to system ground. Capacitor C2 and resistor R2 serve to filter the output signal from diode detector CR1 and thus provide a relatively slow, time varying voltage to the next stage of the circuit.

The output signal from diode detector CR1 is coupled to the first of two integrated circuit operational amplifiers within the sensing circuit. The first operational amplifier U1 is used for calibrating the workstation mat and for providing sufficient gain to ensure that the alarm will sound when the current threshold setting is reached. More specifically, the output signal from diode CR1 is provided to the operational amplifier U1 at its non-inverting input (shown in FIG. 5 as pin 12). The inverting input (pin 13) of amplifier U1 is coupled to a fixed input resistor R10 to ground and to one leg of a feedback potentiometer R3, whose other leg and wiper are connected to the wiper of slide potentiometer R4. One leg of potentiometer R4 is connected to the output of operational amplifier U1, and the other leg is connected through a fixed resistor R5 to the first leg of another potentiometer R6, whose other leg and wiper are connected to ground.

Potentiometer R4 is the threshold setting slide potentiometer which was described previously. Potentiometer R4 is adjustable by the operator to set the threshold at which the alarm will trigger. Potentiometer R6 is used to adjust the lower end (60 mA) of the high current range scale (that is, the 60–200 mA range). Potentiometer R3 forms part of the feedback loop for operational amplifier U1 and is used to adjust the gain of amplifier U1 so that the alarm will sound at a preset current flowing through the upper conductive plate 2 and resistor R1.

The output of operational amplifier U1 (at pin 14) is provided to the non-inverting input (pin 5) of a second operational amplifier U2. Operational amplifier U2 is used to provide a gain adjustment in accordance with the particular range the operator sets for the workstation mat. An input resistor R7 is connected between the inverting input of amplifier U2 and system ground. A feedback resistor R8 is provided between the output of amplifier U2 (pin 7) and the inverting input (pin 6). In parallel with resistor R8 is the range select switch S1, which is a single pole, single throw switch and which is connected to circuit board terminals 46, 48. In effect, the range select switch S1 will change the gain of amplifier U2 by shorting out feedback resistor R8. Range select switch S1 will be effectively an open circuit when the workstation mat is operated in the low current range, i.e., up to 60 mA. In this case, the gain of amplifier U2 will be approximately 3 (R8+R7/R7). Feedback resistor R8 and input resistor R7 are selected preferably to provide such gain. When the operator selects the high current range (60 mA–200 mA), range select switch S1 is effectively closed and shorts out feedback resistor R8, so that amplifier U2 provides unity gain.

The sensing circuit of the workstation mat is calibrated in the following manner. The wiper of slide potentiometer R4 is moved all the way to one position, which is the 200 mA reading on the scale 21 shown in FIG. 3, which corresponds to the upper position of the wiper as seen in FIG. 5. This constitutes a setting of 200 mA, which is the high end of the 60–200 mA range. The range select switch S1 is switched to the 200 mA setting, as shown in FIG. 3, which is effectively a short circuit and shunts resistor R8. Thus, the gain of amplifier U2 will be 1. Resistor R3 is now adjusted so that, with 200 mA of current flowing through sensing resistor R1, the alarm will sound.

Next, slide potentiometer R4 is readjusted so that it reads 60 mA on the 60–200 mA scale, which is to the left on the scale 21 as shown in FIG. 3 or with the wiper in its lowermost position, as shown in the schematic of FIG. 5. With 60 mA of current flowing through sensing resistor R1, potentiometer R6 is now adjusted so the alarm just sounds.

The output of amplifier U2 (pin 7) is provided to one coil end (terminal 2) of a dual coil latching relay K1. The other end of the coil (terminal 15) is connected to system ground, one end (terminal 16) of the second coil in relay K1 and to the negative lead of the piezo buzzer alarm 32 through circuit board terminal 50. The other end (terminal 1) of the second coil in relay K1 is connected to circuit board terminal 52.

Relay K1 includes a pair of single pole, double throw switching circuits. More specifically, one switching circuit includes a wiper (on terminal 13) which, when the relay is unenergized or reset, contacts one pole (terminal 9) and when energized or set, contacts the other pole (terminal 11). Similarly, the other switching circuit includes a wiper (on terminal 4) which, when the relay is unenergized or reset, contacts one pole (terminal 8), and when energized or set, contacts the other pole (terminal 6).

The positive lead of piezo buzzer alarm 32 is coupled to terminal 13 of relay K1 through circuit board terminal 54. The positive voltage from the DC power supply is provided to terminal 11 of relay K1 through circuit board terminal 56.

When the induced current detected by the sensing circuit reaches the current threshold, the output of amplifier U2 will energize the first coil in relay K1. Terminals 11 and 13 of relay K1 will then be electrically connected, causing current to flow through the alarm 32, sounding the alarm. Preferably, the relay K1 remains latched in its set state so that the alarm will continue to sound should the field induced current fall below the current threshold.

To reset the alarm, push button switch S2 is used as mentioned previously. Reset switch S2 is a single pole, single throw momentary push button switch, normally open, and its terminals are connected across circuit board terminal 52 and terminal 58. Terminal 58 is connected to the positive voltage from the power source through a current limiting resistor R9. When reset switch S2 is pushed, the second coil of relay K1 is energized, which returns the switching circuits of the relay to their normal deenergized positions.

As also mentioned previously, the workplace mat is adapted to be connected to a remote reset. Connector J3, discussed previously, is provided for this purpose. As shown, a remote reset switch S3, configured in the same manner as reset switch S2, may be connected to circuit board terminal 58 and 52 through connector J3 to energize the second coil of relay K1 in order to reset relay K1.

The second switching circuit of relay K1 is used to control a remote relay 60 through connector J2 described previously. Remote relay 60 may be used to sound a remote alarm 62 connected to the relay.

The LED indicator 17 is connected between system ground and the positive voltage source through a current limiting resistor R11. LED 17, when illuminated, indicates to the operator that the workstation mat is energized.

Amplifiers U1 and U2 may be formed from a dual amplifier integrated circuit. Accordingly, as shown in FIG. 5, the positive DC voltage is applied to pin 4 of the integrated circuit and pin 11 of the circuit is grounded.

A parts list for the circuit shown in FIG. 5 is provided below. Also, the pin numbers shown in FIG. 5 for integrated circuit operational amplifiers U1 and U2 relate to the part specified in the list, although, of course, it is envisioned that components comparable to those listed below, connected differently from that shown in FIG. 5, may be suitable for use.

PARTS LIST FOR CIRCUIT SHOWN IN FIG. 5

| Part Description | Reference Designation |
|---|---|
| Resistor 9.1 OHMS | R1 |
| Resistor 1M OHMS | R2 |
| Potentiometer 50 K OHMS | R3 |
| Potentiometer 1 K OHMS | R4 |
| Resistor 240 OHMS | R5 |
| Potentiometer 200 OHMS | R6 |
| Resistor 1.5 K OHMS | R7 |
| Resistor 3.24 K OHMS | R8 |
| Resistor 51 OHMS | R9 |
| Resistor 51 K OHMS | R10 |
| Capacitor 200 pf | C1 |
| Capacitor 0.1 μf | C2 |
| Diode 1N270 | CR1 |
| Light Emitting Diode | CR2 |
| 1/2 LM 342N | U1 |
| 1/2 LM 342N | U2 |

-continued

PARTS LIST FOR CIRCUIT SHOWN IN FIG. 5

| Part Description | Reference Designation |
|---|---|
| Single Pole, Single Throw Switch | S1 |
| Reset Switch | S2 |
| Dual Coil Latching Relay | K1 |

An embodiment of the present invention was tested for accuracy over a range of frequencies at a two different current threshold settings. More specifically, the workstation mat was tested on both the low current range and the high current range. On the low current range, the threshold setting was set at 63.2 mA by adjusting the range select switch S1 and potentiometer R4. Similarly, on the high current range, the threshold setting was set to 200 mA.

Figure 6:
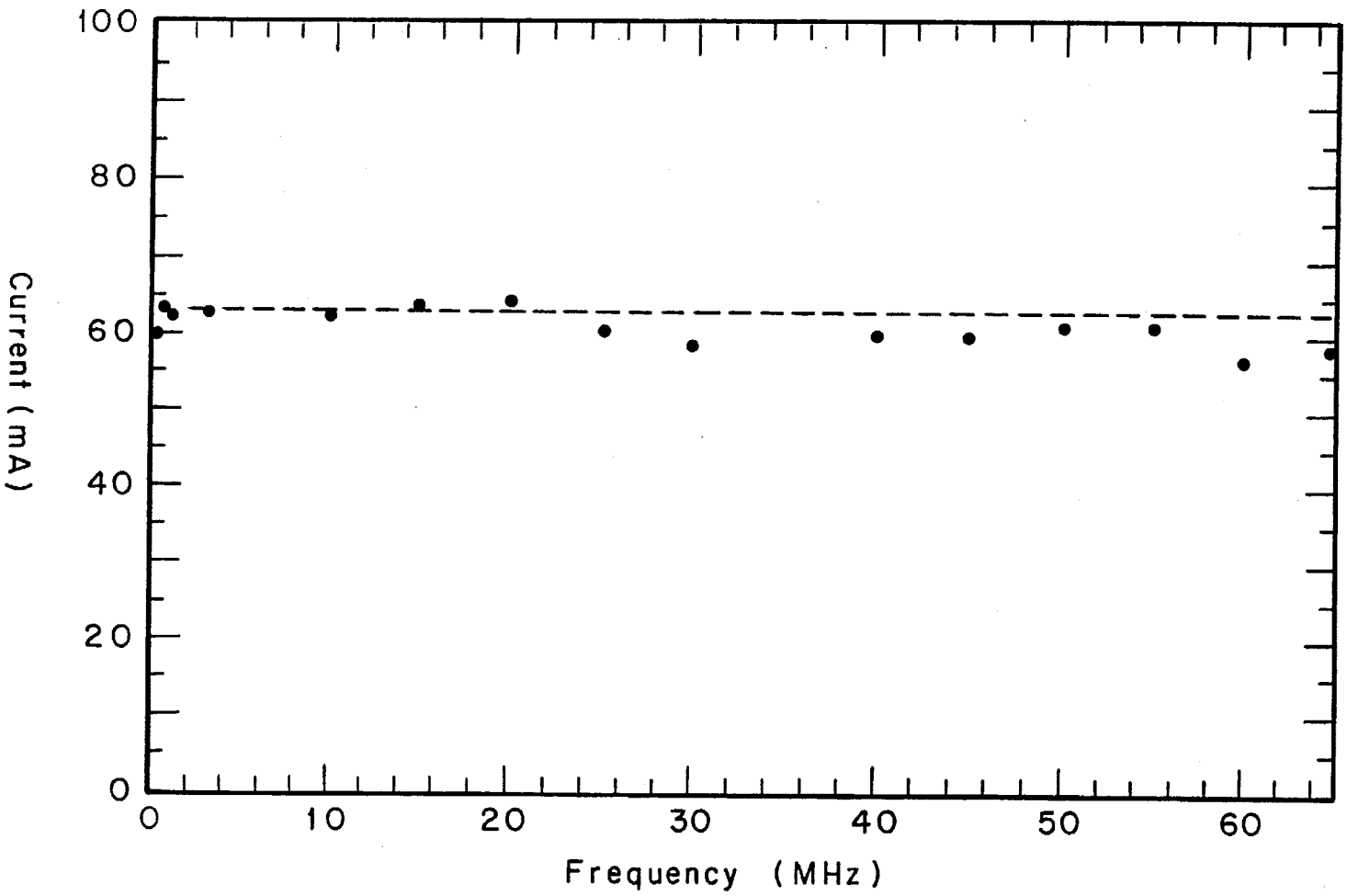
FIG. 6 is a graph showing the response of the workstation mat over frequency for a low calibration current.
Figure 7:
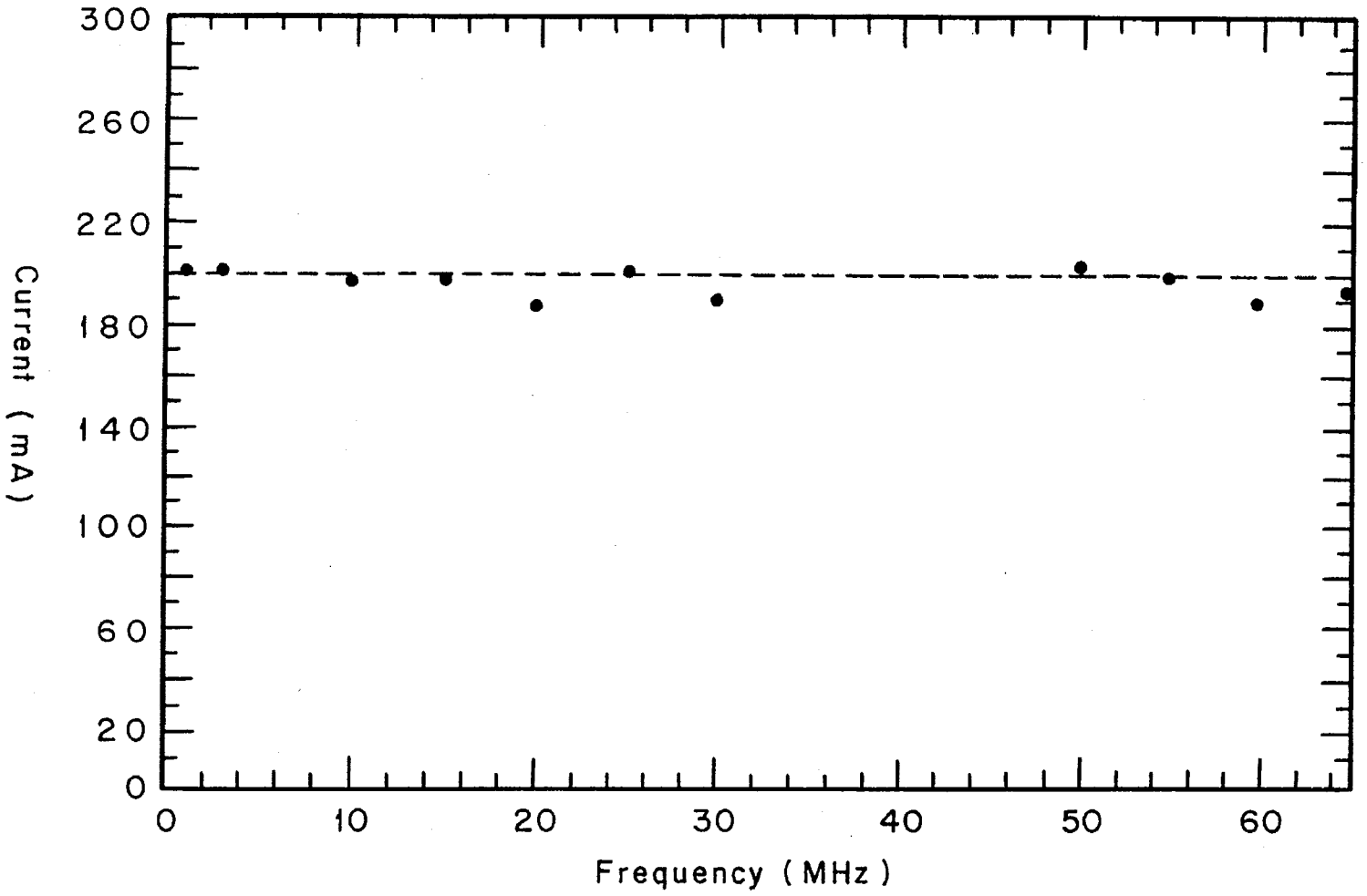
FIG. 7 is a graph showing the response of the workstation mat over frequency for a high calibration current.

The results of the tests are plotted on the graph shown in FIG. 6 and FIG. 7. In FIG. 6 and FIG. 7, the actual currents that were required to sound the alarm at the various frequencies are shown as dots and the threshold setting of the workstation mat is shown as a dashed line. FIG. 6 shows the test results with respect to the low current range and FIG. 7 shows the test results with respect to the high current range. As shown in FIG. 6 and FIG. 7, the workstation mat alarm was sounded at the various frequencies with less than a ±10% variation between the input current relative to the desired alarm threshold setting.

As set forth in the foregoing description, the workstation mat of the present invention provides a metering device which monitors a worker's exposure to radio frequency, electromagnetic fields. The workstation mat is highly accurate to sounding an alarm when the induced current caused by radio frequency, electromagnetic fields reaches the threshold setting. The threshold setting may be changed by the user to a desired value. Furthermore, the workstation mat may be conveniently positioned on the floor so that a worker may stand on the mat while working. The mat is portable and may be moved to whatever location a worker desires. The mat will not hinder or interfere with the worker's performance, yet it will accurately monitor the current induced by radio frequency, electromagnetic waves within the worker's body. The workstation mat provides the worker with an audible alarm when the induced current reaches threshold setting, and is adapted to trigger a remote alarm as well.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed:

1. A metering device for monitoring electromagnetic field induced currents flowing through the body of a person which comprises:

a workstation mat adapted to be positioned on a floor in a work area such that a person stands on the workstation mat to measure electromagnetic field induced currents flowing through the person, the workstation mat including;

an upper conductive plate;

a lower conductive plate, the upper conductive plate being superposed over the lower conductive plate and spaced apart therefrom, the upper and lower conductive plates residing in parallel planes; and an electronic circuit coupled to the upper and lower conductive plates, the electronic circuit sensing the induced current flowing through the person's body and into the upper conductive plate of the workstation mat and indicating when the induced body current exceeds a predetermined current threshold.

2. An electromagnetic field induced body current workstation mat as defined by claim 1, wherein the workstation mat further includes an insulating material, the insulating material being interposed between the upper and lower conductive plates.

3. An electromagnetic field induced body current workstation mat as defined by claim 2, wherein the insulating material has formed therein a cutout, the cutout being provided to house the electronic circuit, the electronic circuit being disposed in the cutout and positioned between the upper and lower conductive plates.

4. An electromagnetic field induced body current workstation mat as defined by claim 1, wherein the electronic circuit includes means for sensing current flowing into the upper conductive plate, the current sensing means being electrically coupled to the upper and lower conductive plates; means for setting the current threshold, the threshold setting means being coupled to the current sensing means; and alarm means coupled to the current threshold setting means for indicating when the current sensed by the current sensing means is at least equal to the current threshold set by the current threshold setting means.

5. An electromagnetic field induced body current workstation mat as defined by claim 4, wherein the alarm means includes at least a first relay coupled to the current threshold setting means, the first relay being in a first state when the current sensed by the current sensing means is below the current threshold set by the current threshold setting means, and being in a second state when the sensed current is at least equal to the current threshold; and wherein the alarm means includes at least a first alarm coupled to the first relay, the first alarm being energized when the first relay is in the second state.

6. An electromagnetic field induced body current workstation mat as defined by claim 5, wherein the first relay is a latching relay, and wherein the electronic circuit includes at least a first reset switch coupled to the latching first relay, the first reset switch being positionable in at least a first position, the first reset switch causing the latching first relay to switch from the second state to the first state when the first reset switch is in the first position.

7. An electromagnetic field induced body current workstation mat as defined by claim 6, wherein the electronic circuit includes a remote second reset switch coupled to the latching first relay, the remote second reset switch being positionable in at least a first position, the remote second reset switch causing the latching first relay to switch from the second state to the first state when the remote second reset switch is in the first position.

8. An electromagnetic field induced body current workstation mat as defined by claim 5, wherein the alarm means includes a remote second relay, the remote second relay being coupled to the first relay, the remote second relay being in a first state when the current sensed by the current sensing means is below the current threshold set by the current threshold setting means, and being in a second state when the sensed current is at least equal to the current threshold.

9. An electromagnetic field induced body current workstation mat as defined by claim 4, wherein the electronic circuit includes an indicator light to indicate when electric power is applied to the electronic circuit.

10. An electromagnetic field induced body current workstation mat as defined by claim 9, wherein the indicator light is at least partially exposed through the upper conductive plate.

11. An electromagnetic field induced body current workstation mat for monitoring field induced currents flowing through the body of a person standing on the mat, which comprises:

an upper conductive plate;

a lower conductive plate, the upper conductive plate being superposed over the lower conductive plate and spaced apart therefrom, the upper and lower conductive plates residing in parallel planes;

an electronic circuit coupled to the upper and lower conductive plates, the electronic circuit sensing the induced current flowing through the person's body and into the upper conductive plate and indicating when the induced body current exceeds a predetermined current threshold; and a cover, the cover being disposed over at least a portion of the upper conductive plate and being formed of a material which minimizes slippage by a person standing on the mat.

12. An electromagnetic field induced body current workstation mat as defined by claim 11, wherein the workstation mat further includes anti-slip material mounted on the lower conductive plate to minimize slippage of the workstation mat when the mat is placed on a floor.

13. An electromagnetic field induced body current workstation mat for monitoring field induced currents flowing through the body of a person standing on the mat, which comprises:

an upper conductive plate;

a lower conductive plate, the upper conductive plate being superposed over the lower conductive plate and spaced apart therefrom, the upper and lower conductive plates residing in parallel planes; and an electronic circuit coupled to the upper and lower conductive plates the electronic circuit sensing the induced current flowing through the person's body and into the upper conductive plate and indicating when the induced body current exceeds a predetermined current threshold, and wherein the electronic circuit includes means for sensing current flowing into the upper conductive plate, the current sensing means being electrically coupled to the upper and lower conductive plates; means for setting the current threshold, the threshold setting means being coupled to the current sensing means; and alarm means coupled to the current threshold setting means for indicating when the current sensed by the current sensing means is at least equal to the current threshold set by the current threshold setting means, and wherein the mat includes a lateral side; and wherein the current threshold setting means includes a potentiometer which is at least partially exposed on the lateral side of the mat to allow a person to contact the potentiometer and thereby adjust the current threshold setting.

14. An electromagnetic field induced body current workstation mat as defined by claim 13, wherein the mat includes at least one scale mounted on the side of the mat and positioned adjacent to the potentiometer.

* * * * *